US011273092B2

(12) United States Patent
Garvin

(10) Patent No.: US 11,273,092 B2
(45) Date of Patent: Mar. 15, 2022

(54) REUSABLE CASKET

(71) Applicant: J. GARVIN INDUSTRIES, INC., Posen, IL (US)

(72) Inventor: John Garvin, Evergreen Park, IL (US)

(73) Assignee: J. GARVIN INDUSTRIES, INC., Posen, IL (US)

( * ) Notice: Subject to any disclaimer, the term of this patent is extended or adjusted under 35 U.S.C. 154(b) by 0 days.

(21) Appl. No.: 16/988,804

(22) Filed: Aug. 10, 2020

(65) Prior Publication Data

US 2021/0121351 A1 Apr. 29, 2021

Related U.S. Application Data

(60) Provisional application No. 62/925,872, filed on Oct. 25, 2019.

(51) Int. Cl.
*A61G 17/00* (2006.01)
*A61G 17/04* (2006.01)

(52) U.S. Cl.
CPC ..... *A61G 17/001* (2017.05); *A61G 17/042* (2016.11)

(58) Field of Classification Search
CPC .. A61G 17/001; A61G 17/004; A61G 17/042; A61G 17/044
USPC ..... 27/2, 19, 35
See application file for complete search history.

(56) References Cited

U.S. PATENT DOCUMENTS 4,063,337 A * 12/1977 Havey, III ..... A61G 17/001 27/2
4,249,289 A * 2/1981 Work ..... A61G 17/041 27/35
5,481,785 A * 1/1996 Minton ..... A61G 17/034 27/27
5,956,825 A * 9/1999 McCoy ..... A61G 17/041 27/2
6,385,824 B1 * 5/2002 Schwartz ..... A61G 17/001 27/35
7,350,278 B2 4/2008 Davis et al.
9,918,891 B1 * 3/2018 Hallam ..... B65D 90/24
10,500,117 B2 12/2019 Davis et al.
10,596,055 B1 * 3/2020 Fernandez ..... A61G 17/0136
2005/0108863 A1 * 5/2005 Fash ..... A61G 17/001 27/2
2009/0031931 A1 2/2009 Steinhaus
2015/0164729 A1 6/2015 Cox et al.
2016/0000632 A1 * 1/2016 Hoijng ..... A61G 17/001 27/2
2016/0228318 A1 * 8/2016 Hoijng ..... A61G 17/02
2017/0281448 A1 10/2017 Davis et al.
2019/0380902 A1 12/2019 Davis et al.

* cited by examiner

*Primary Examiner* — William L Miller

(74) *Attorney, Agent, or Firm* — Greer, Burns & Crain Ltd.

(57) ABSTRACT

A reusable casket has a four-sided frame. A base is also provided. The base extends to the outer edges of the frame, so the frame rests on top of the base. Trim pieces surrounding the bottom of the frame are offset so that the base is hidden from view when the frame is on the base. The offset also creates a pocket that holds the base in place, in part, when attached to the frame. The base is manually secured to and released from inside of the frame by release buckles having male and female ends, each of which has an attached polypropylene strap. The straps of the male ends are secured inside of the frame. The straps of the female ends pass through openings in the base, and are secured to the underside of the base.

10 Claims, 8 Drawing Sheets

REUSABLE CASKET

This invention relates to caskets, and more particularly, to caskets that can be reused. Reusable caskets can also be referred to as rental caskets, ceremonial caskets, or presentation caskets.

BACKGROUND OF THE INVENTION

Many people are cremated after death, with the option of a viewing or memorial service by family and friends before cremation takes place. Because being cremated eliminates the need to purchase a traditional metal or wood casket for viewing and then internment, reusable caskets are a lower cost alternative option to present the deceased for viewing.

When using a reusable casket, the deceased's body is initially placed in a removable tray. Removable trays can also be referred to as corrugated cardboard cremation trays, reusable inserts, or rental casket inserts. A removable tray is a one-time use tray, which typically has a leak-resistant plastic lining, fabric interior, pillow, and blanket. The removable tray, with the deceased's body, is placed into the reusable casket for viewing of the deceased. After the viewing, the tray containing the deceased is removed from the reusable casket and transported to the crematory for cremation.

Conventional reusable caskets, which can be metal or wood, have a base, two side panels, two end panels, a head lid, and a foot lid. The lids are usually independent of each other and allow for the bottom lid (over the legs) to be closed and the head lid to be open for viewing. At the foot-end of the reusable casket is a hinged drop-door, which allows the removable tray and the body to be slid out of the reusable casket onto a dolly. This type of system can be cumbersome since the removable tray and body are heavy. It may require more than one person to remove the tray, and it typically requires the use of a second dolly to rest the tray and body on.

Also, this type of system typically requires that both the head lid and foot lid be open when the tray and body are removed. This creates a stability issue. When the removable tray and body are inside of the reusable casket, the casket is stable. Once the tray and body are removed, the reusable casket may become unstable, top-heavy, and have a tendency to flip backwards because of the weight of the open head and foot lids. Thus, there is a need for a reusable casket, which allows for transfer of the removable tray and body from the casket with less effort and more stability.

Accordingly, one objective of this invention is to provide a new and improved reusable casket.

Another objective is to provide a new and improved reusable casket that allows for easier removal of the tray and body and eliminating instability issues.

SUMMARY OF THE INVENTION

In keeping with one aspect of this invention, a reusable casket has two side panels and two end panels fixed to each other to form a one-piece, four-sided frame, and a base. The base extends to the outer edges of the frame, so the frame rests on top of the base. Trim pieces surrounding the bottom of the frame are offset so that the base is hidden from view when the frame is on the base. The offset also creates a pocket that holds the base in place when attached to the frame.

Manually operated connecting means are provided for manually securing the base and the frame to each other, and manually releasing the base and frame from each other. In one embodiment, release buckles have male and female ends, each of which has an attached polypropylene strap. The straps of one of the buckle ends are secured to the inside of the frame. The straps of the other buckle end pass through openings in the base, and are secured to the underside of the base.

By manually releasing the release buckles, the four-sided frame can be removed from the base without having to remove the tray and the body first. This new and improved design eliminates removing the body onto a second dolly and virtually eliminates the instability found in conventional reusable caskets with head and foot lids.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
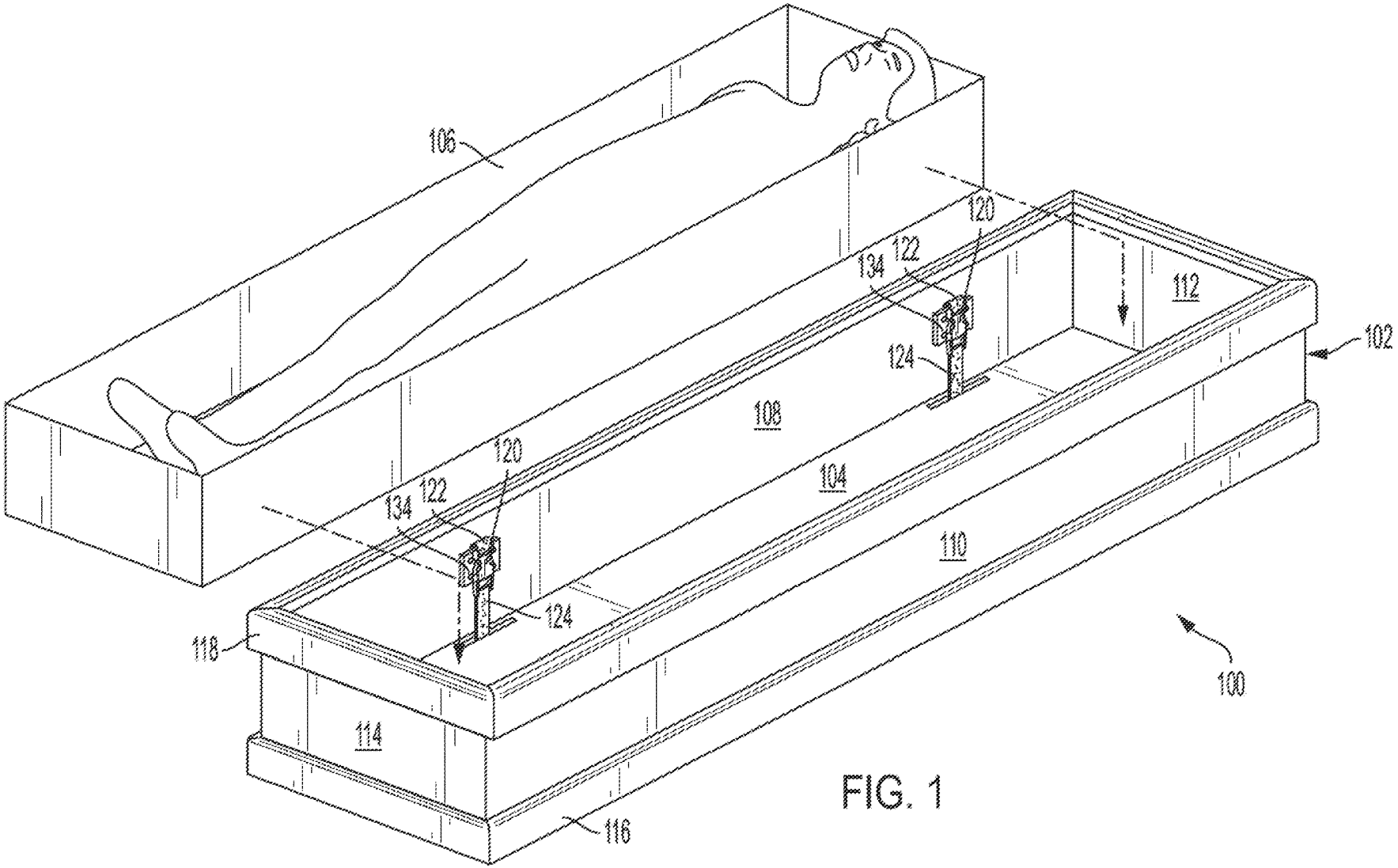
FIG. 1 is a perspective view of a reusable casket made according to one embodiment of the invention.

As seen in FIG. 1, a casket 100 has a frame 102 and a base 104. The casket is designed so that a removable cremation tray 106 can be placed in the casket 100. The removable tray 106 typically has a leak-resistant plastic lining, fabric interior, pillow, and blanket, and the body of a deceased person is placed in the cremation tray 106 for viewing at a funeral home or church.

The frame 102 has a first side panel 108, a second side panel 110, a first end panel 112, and a second end panel 114, typically made of plywood, nailed and glued together, and stained on the inside and outside. The panels 108 and 110 are opposed to each other, and panels 112 and 114 are opposed to each other.

Figure 2:
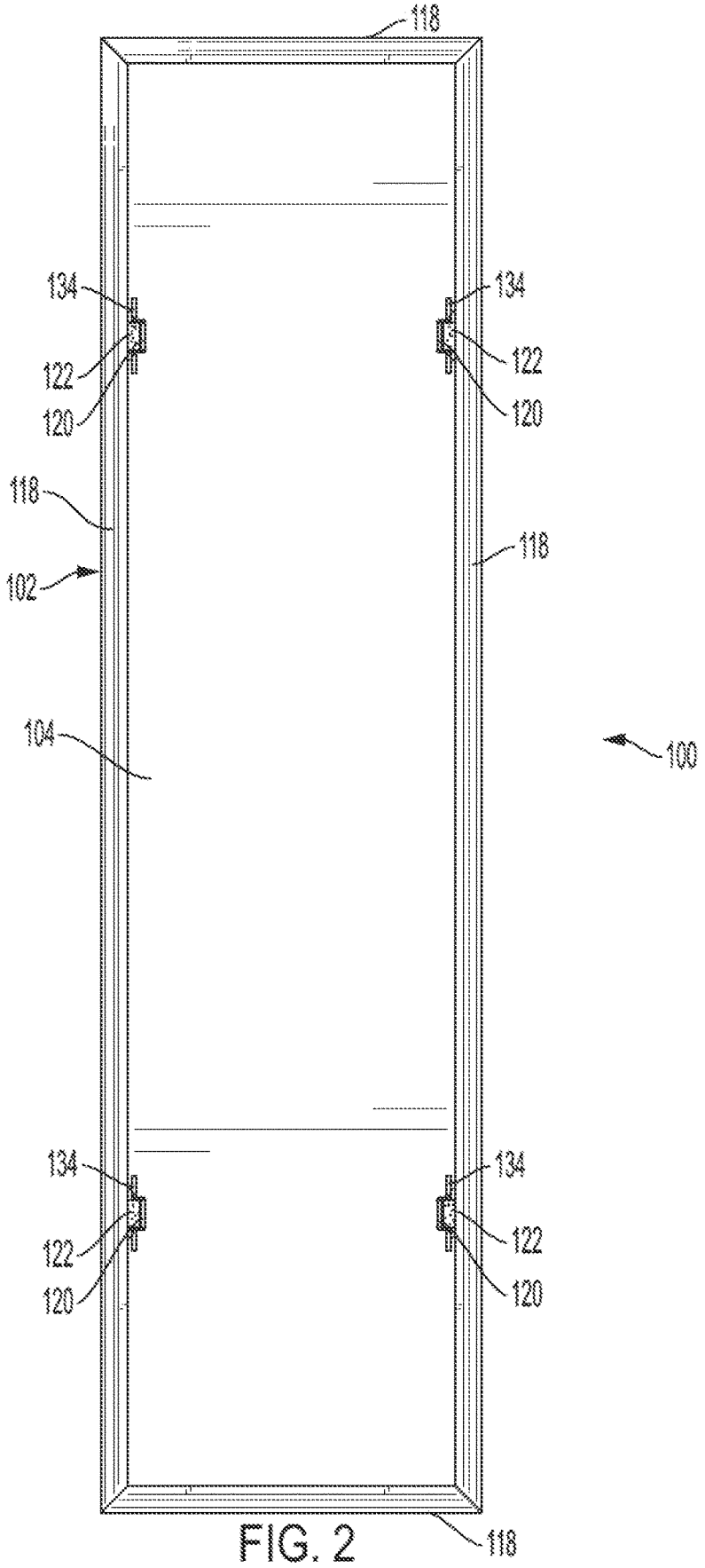
FIG. 2 is a plan view of the inside of the reusable casket of FIG. 1.

Lower trim pieces 116 are provided along the bottom edge of the frame 102 (as oriented in FIG. 1), and upper trim pieces 118 are provided along a top edge of the frame 102 The upper trim pieces 118 cover part of the outside surface of the frame 102, and also cover the exposed edges of the plywood used for the frame 102, as seen in FIG. 2 as well as FIG. 1. The trim is stained, nailed and glued, as well.

Figure 4:
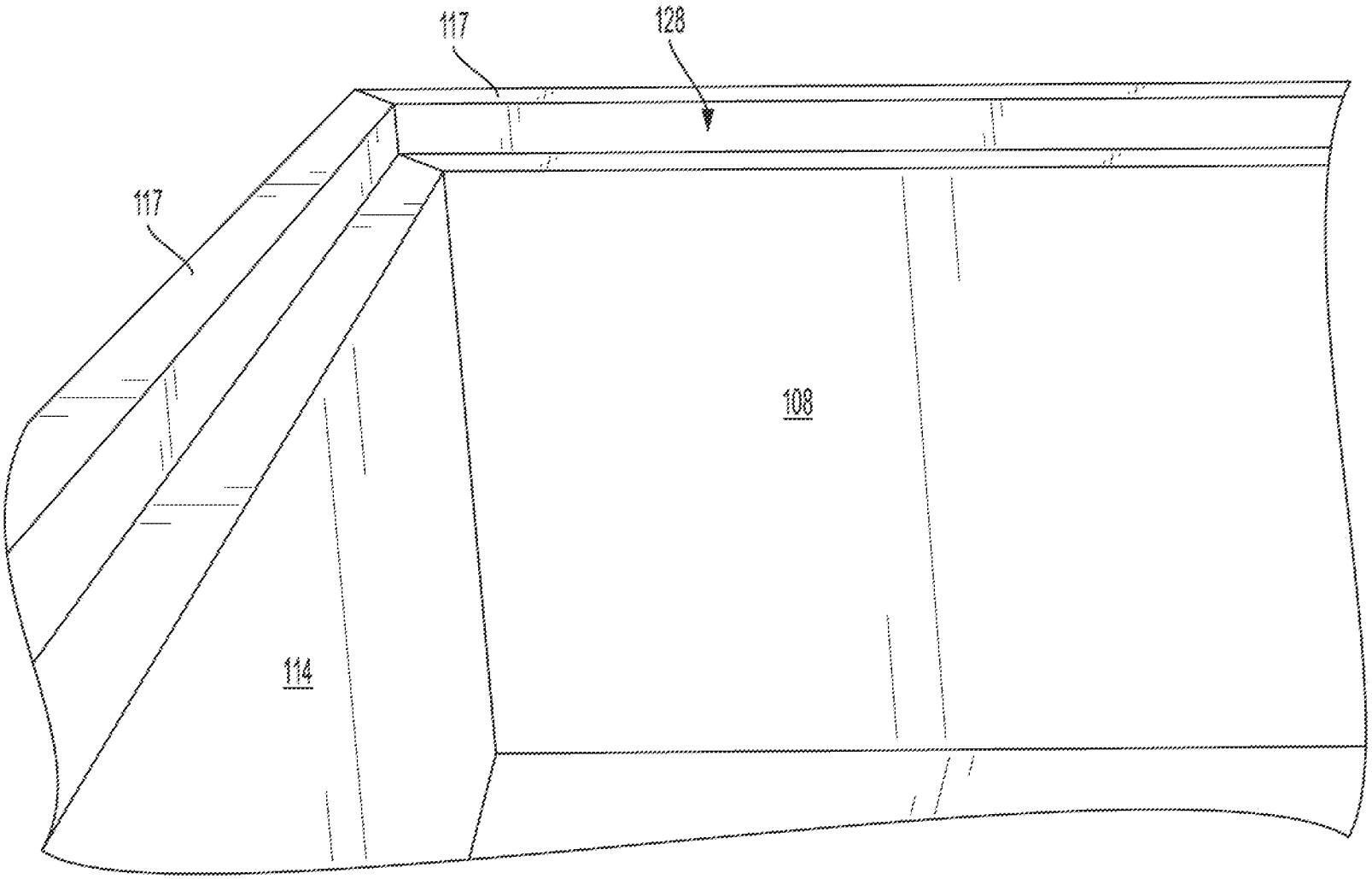
FIG. 4 is a cutaway view of a corner of the bottom shown in FIG. 3, showing the base removed from the frame.
Figure 5:
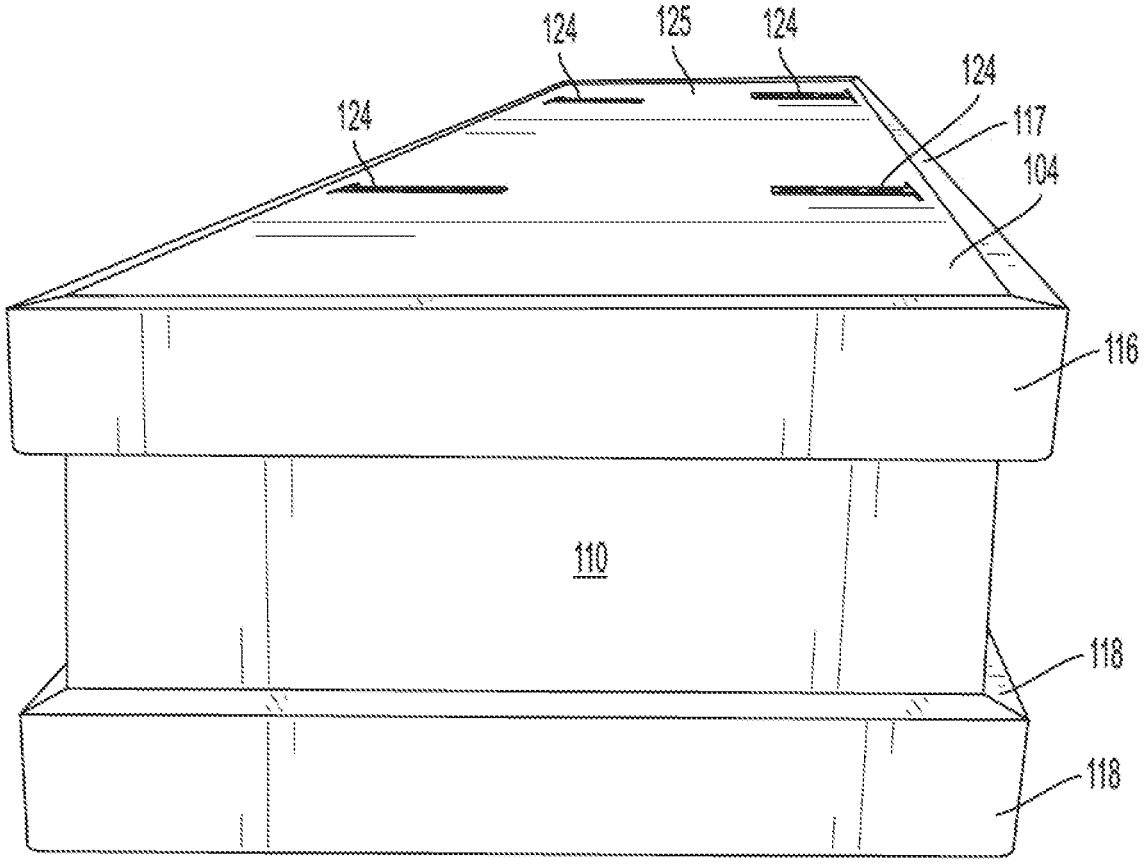
FIG. 5 is a close-up view of the corner of the bottom shown in FIG. 3, showing the base secured to the frame.

The lower trim pieces 116 are offset with respect to a bottom edge of the frame to form a pocket 128, as seen in FIG. 4. When the frame 102 is on the base 104, the base 104 is flush with the exposed outer edges 117 of the trim pieces 116 (FIG. 5), and is secured in part by the pocket 128.

The frame 102 is secured to the base 104 by a sufficient number of connection devices. In the embodiment of FIGS. 1 and 2, four release buckles 120 are provided. Polypropylene straps 122 are secured to male end 130 of the release buckles 120, and to the inside of the frame 102. Staples 123 seen in FIG. 7 can be used for this purpose.

Figure 3:
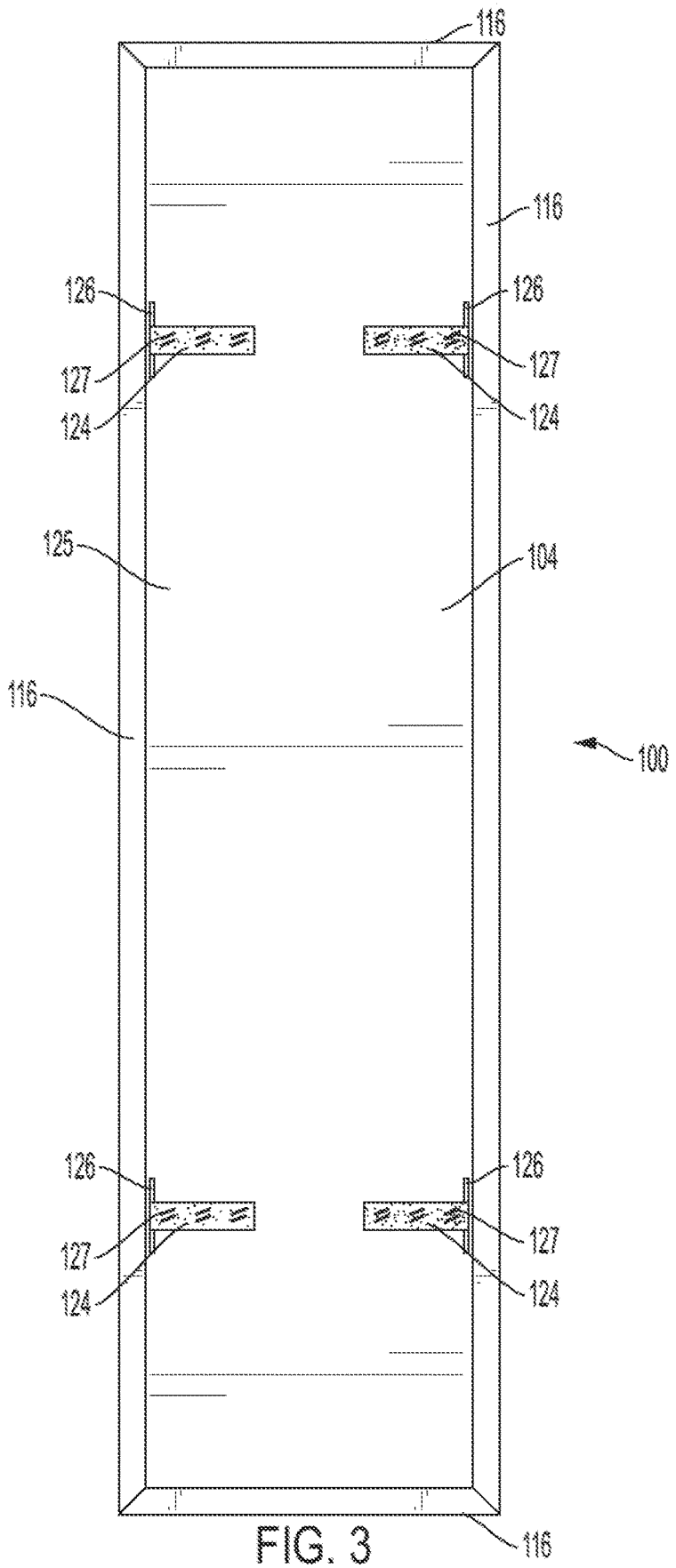
FIG. 3 is a plan view of the bottom of the reusable casket of FIG. 1.

Polypropylene straps 124 secured to female end 132 of the buckles 120 pass through openings 126 in the base 104, and are secured to a bottom 125 of the base 104, as seen in FIG. 3. Openings 126 are adjacent to the side panels 108 and 110 (FIGS. 1 and 3), and are preferably slits. Staples 127 secure the straps 124 to the base 104.

Figure 6:
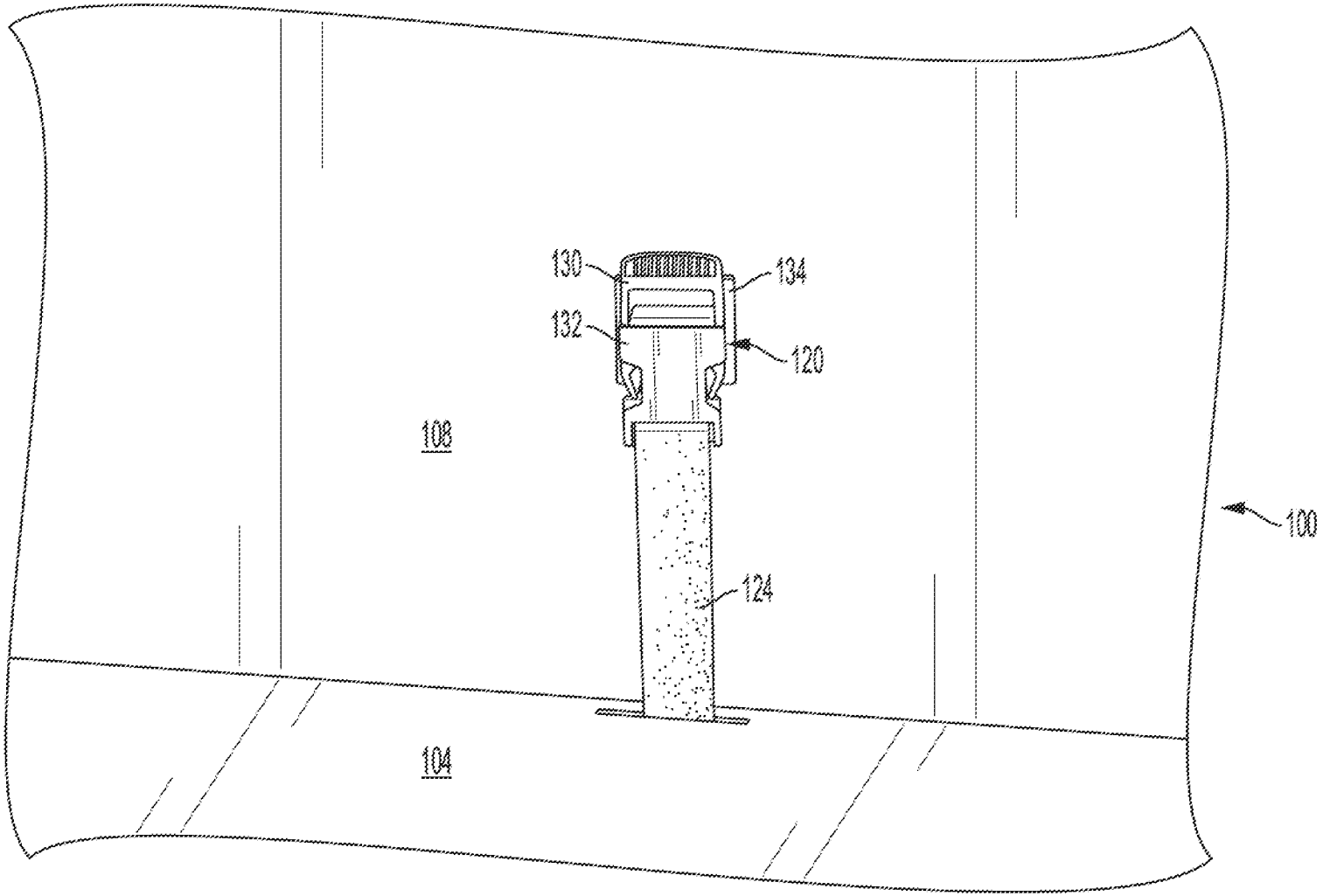
FIG. 6 is a close-up view of a release buckle used in the reusable casket of FIG. 1, showing the male and female ends engaged.
Figure 8:
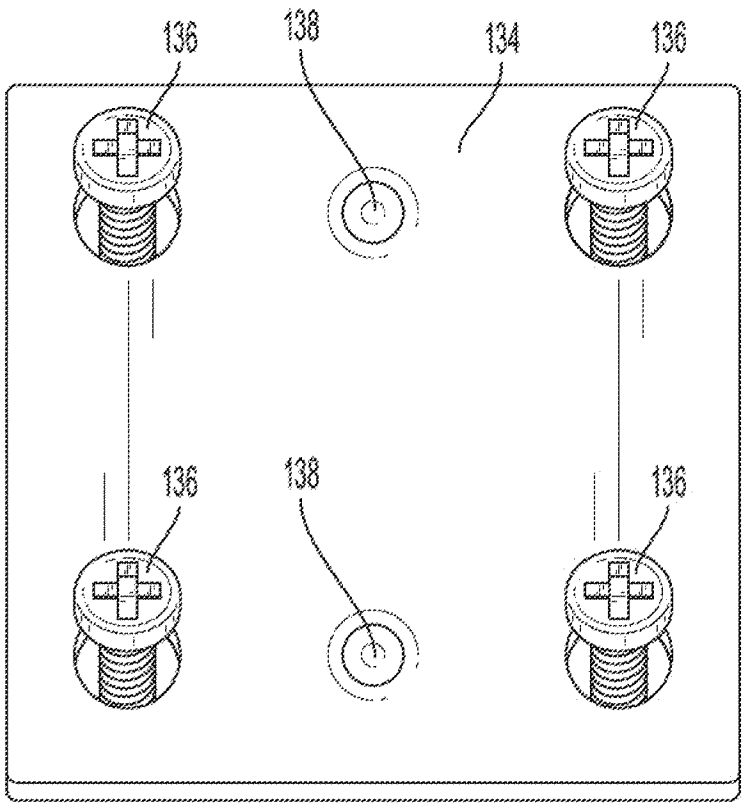
FIG. 8 is a close-up view of an attachment plate used to secure the straps of the male ends of the release buckles to the frame show in FIGS. 1, 6, and 7.
Figure 7:
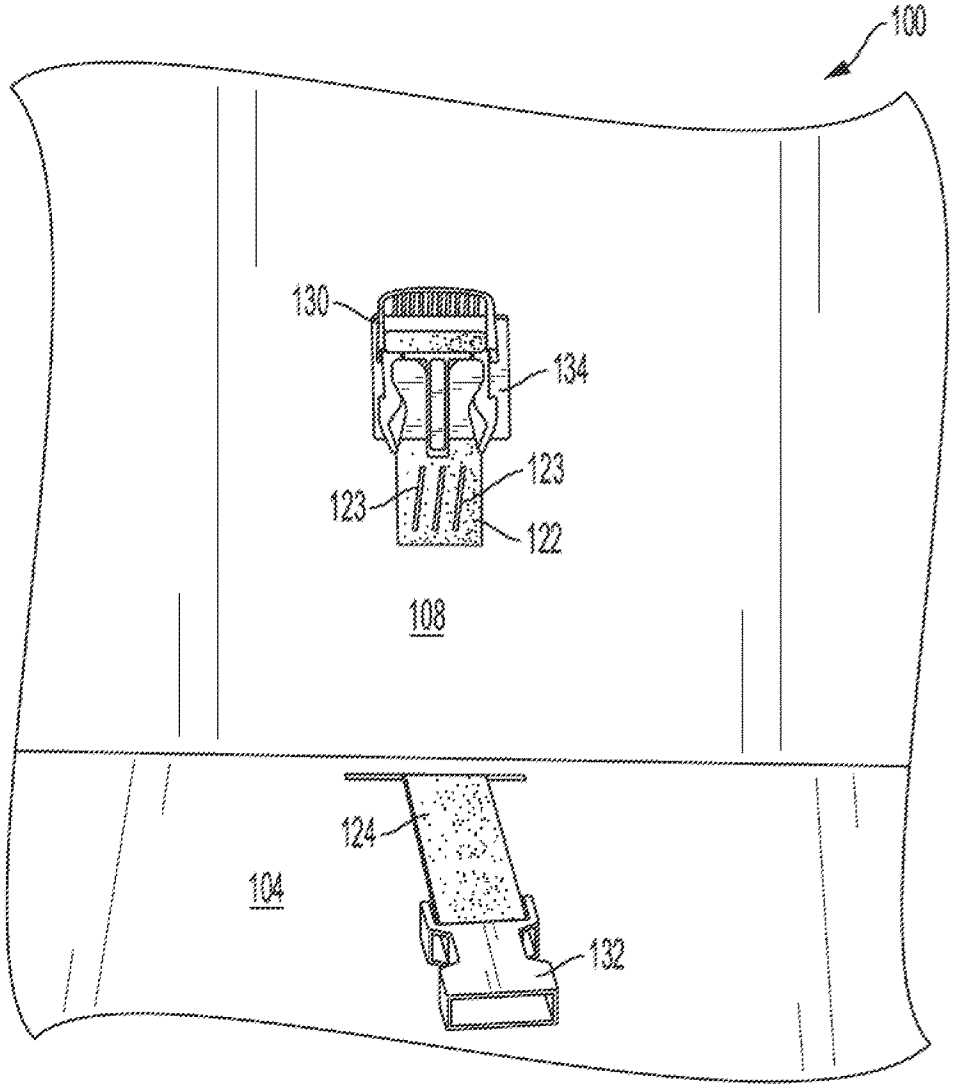
FIG. 7 is a close-up view of a release buckle used in the reusable casket of FIG. 1, showing the male and female ends disengaged.

The release buckles 120 and straps 122, 124 are shown in greater detail in FIGS. 6, 7, and 8. The release buckles 120 have a male end 130 and a female end 132. In the example shown, four release buckles are used. The male ends 130 are secured to the frame 102, and the female ends 132 secured to the base 104. The buckles 120 are engaged FIG. 6 and disengaged in FIG. 7.

The male ends 130 are further secured to the inside of the frame 102 by attachment plates 134 (FIG. 8). The plates 134 are secured to the side panels 108 and 110 by screws 136. The straps 122 pass between the plates 134 and the panels. The ends of the straps 122 to which the male ends 130 are attached pass over the top of the plates 134, and the other ends of the straps 122 are stapled to the panel beneath the plates 134 (FIG. 7). The plates 134 have two dimples 138 that further secure the strap 122.

Figure 9:
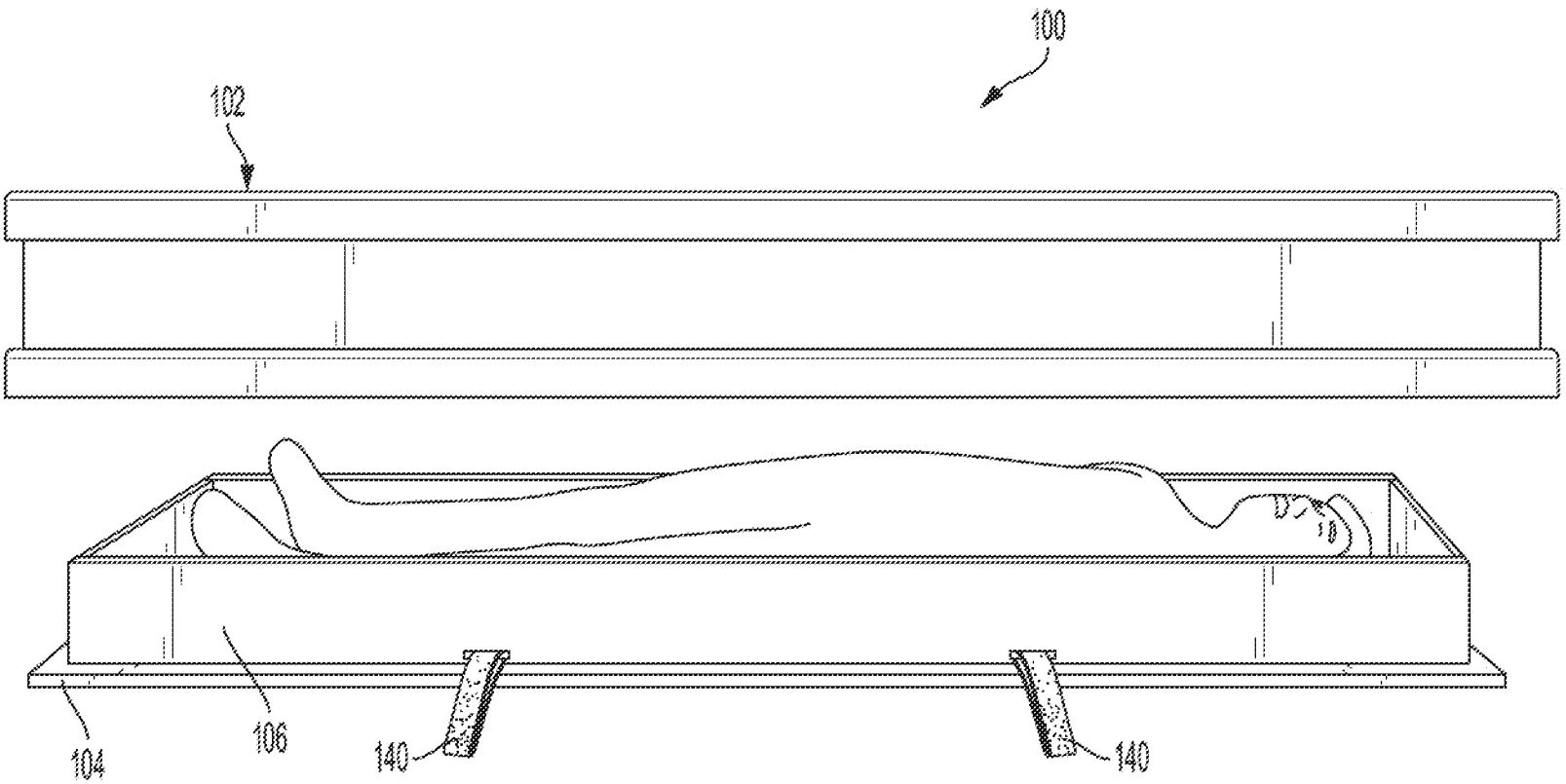
FIG. 9 is a side view of the reusable casket of FIG. 1 in use, showing the frame removed from the base.

In use, the frame 102 can be easily secured to the base 104, either before or after the cremation tray 106 is placed on the base 104, by engaging the release buckles 120. The frame 102 can be easily removed from the base 104 by releasing the male ends 130, and lifting the frame 102, as seen in FIG. 9. The cremation tray 106, with the body undisturbed, can be slid off of the base 104 or lifted off of the base 104 using straps 140. The cremation tray is then placed in a vehicle for transport to a crematorium.

While the principles of the invention have been described above in connection with specific apparatus and applications, it is to be understood that this description is made only by way of example and not as a limitation on the scope of the invention.

What is claimed is:

1. A reusable casket comprising:

first and second side panels, and first and second end panels, the first and second side panels and the first and second end panels being arranged and secured to form a rectangular frame, a base, lower trim pieces secured to the frame along a bottom edge of the frame, the lower trim pieces being offset with respect to the bottom edge of the frame to form a pocket, wherein when the frame is secured to the base, the base is flush with exposed outer edges of the lower trim pieces, and the base is secured in part by the pocket, and manually operated connecting means inside of the frame for manually securing the frame and the base to each other, and manually releasing the frame from the base.

2. The reusable casket of claim 1 comprising upper trim pieces covering part of an outside surface of the frame, the upper trim pieces also covering exposed edges of the frame.

3. The reusable casket of claim 1 wherein the connecting means comprises a plurality of release buckles each having a first end, and a second end that mates with the first end, the first ends being secured to the frame, and the second ends being secured to the base.

4. The reusable casket of claim 3 wherein the first ends of the release buckles are directly secured to first straps, the first straps being secured to the frame, and the second ends of the release buckles are directly secured to second straps, the second straps passing through openings in the base and being secured to a bottom of the base.

5. The reusable casket of claim 4 comprising a plurality of plates secured to the frame, wherein the first straps are secured between the plates and the frame, and ends of the first straps to which the first ends are attached pass over a top of the plates.

6. The reusable casket of claim 5 wherein the plates are secured to the frame by screws, and the plates have at least one dimple to further secure the first straps to the frame.

7. A reusable casket comprising:

first and second side panels, and first and second end panels, the first and second side panels and the first and second end panels being arranged and secured to form a rectangular frame, a base, and manually operated connecting means inside of the frame for manually securing the frame and the base to each other, and manually releasing the frame from the base, wherein the connecting means comprises a plurality of release buckles each having a first end, and a second end that mates with the first end, the first ends being secured to the frame, and the second ends being secured to the base.

8. The reusable casket of claim 7 wherein the first ends of the release buckles are directly secured to first straps, the first straps being secured to the frame, and the second ends of the release buckles are directly secured to second straps, the second straps passing through openings in the base and being secured to a bottom of the base.

9. The reusable casket of claim 8 comprising a plurality of plates secured to the frame, wherein the first straps are secured between the plates and the frame, and ends of the first straps to which the first ends are attached pass over a top of the plates.

10. The reusable casket of claim 9 wherein the plates are secured to the frame by screws, and the plates have at least one dimple to further secure the first straps to the frame.

* * * * *